US010787953B2

(12) United States Patent
Kaneta

(10) Patent No.: US 10,787,953 B2
(45) Date of Patent: Sep. 29, 2020

(54) DEVICE FOR DETERMINING ABNORMALITIES OF COOLING WATER TEMPERATURE SENSORS

(71) Applicant: HINO MOTORS, LTD., Hino-shi, Tokyo (JP)

(72) Inventor: Motoyoshi Kaneta, Hino (JP)

(73) Assignee: HINO MOTORS, LTD., Hino-shi, Tokyo (JP)

( * ) Notice: Subject to any disclaimer, the term of this patent is extended or adjusted under 35 U.S.C. 154(b) by 243 days.

(21) Appl. No.: 16/077,017

(22) PCT Filed: Feb. 9, 2017

(86) PCT No.: PCT/JP2017/004710

§ 371 (c)(1),
(2) Date: Aug. 9, 2018

(87) PCT Pub. No.: WO2017/138601

PCT Pub. Date: Aug. 17, 2017

(65) Prior Publication Data

US 2019/0032541 A1 Jan. 31, 2019

(30) Foreign Application Priority Data

Feb. 12, 2016 (JP) ..... 2016-024530

(51) Int. Cl.
*F01P 7/16* (2006.01)
*F01P 11/16* (2006.01)
(Continued)

(52) U.S. Cl.
CPC ..... *F01P 7/16* (2013.01); *F01P 11/16* (2013.01); *F02D 45/00* (2013.01); *F02M 26/00* (2016.02); *F02M 26/22* (2016.02)

(58) Field of Classification Search
CPC ..... F01P 7/16; F01P 7/14; F01P 3/00; F01P 3/02; F01P 11/16; F01P 2025/50;
(Continued)

(56) References Cited

U.S. PATENT DOCUMENTS 5,488,938 A * 2/1996 Ohuchi ..... F02D 41/0055 123/568.16
5,517,848 A * 5/1996 Hosoya ..... F01N 3/22 73/114.75
(Continued)

FOREIGN PATENT DOCUMENTS

JP H11159379 A 6/1999
JP 2000-303898 A 10/2000
(Continued)

OTHER PUBLICATIONS

International Preliminary Report on Patentability for PCT/JP2017/004710 dated Aug. 14, 2018, all pages.
(Continued)

*Primary Examiner* — Grant Moubry
*Assistant Examiner* — James G Moubry
(74) *Attorney, Agent, or Firm* — Kilpatrick Townsend & Stockton LLP

(57) ABSTRACT

A coolant temperature sensor abnormality determination device includes a determination unit configured to determine whether or not two coolant temperature sensors, which are configured to detect the temperature of the coolant, have an abnormality. The determination unit has a determination
(Continued)

permission condition under which a reference temperature is set to an estimated temperature of a present time point and the estimated temperature is then changed from the reference temperature by a determination temperature. The determination unit is configured to determine, when the determination permission condition is satisfied, that the two coolant temperature sensors are functioning normally if a discrepancy between detection values of the two coolant temperature sensors is less than a normal temperature that is less than or equal to the determination temperature.

5 Claims, 4 Drawing Sheets

(51) Int. Cl.
*F02M 26/22* (2016.01)
*F02D 45/00* (2006.01)
*F02M 26/00* (2016.01)

(58) Field of Classification Search
CPC ..... F01P 2031/00; F02M 26/00; F02M 26/22; F02M 26/13; F02D 45/00; F02D 2009/0223
See application file for complete search history.

(56) References Cited

U.S. PATENT DOCUMENTS 5,656,771 A * 8/1997 Beswick ..... F01P 11/14 340/449
6,230,553 B1 5/2001 Uchiyama et al.
6,615,647 B2 * 9/2003 Niki ..... F01P 11/16 73/114.68
6,957,570 B2 * 10/2005 Wakahara ..... F01P 11/14 73/114.68
7,010,967 B2 * 3/2006 Wakahara ..... F01P 11/14 73/114.68
9,146,176 B2 * 9/2015 Nishi ..... F01P 11/16
2013/0213324 A1 8/2013 Saitoh

FOREIGN PATENT DOCUMENTS

JP 2012-102687 A 5/2012
WO 2017/138601 A1 8/2017

OTHER PUBLICATIONS

International Search Report for PCT/JP2017/004710 dated Apr. 18, 2017, 2 pages.

* cited by examiner

DEVICE FOR DETERMINING ABNORMALITIES OF COOLING WATER TEMPERATURE SENSORS

TECHNICAL FIELD

The present invention relates to a coolant temperature sensor abnormality determination device that determines whether or not a coolant temperature sensor, which detects the temperature of a coolant flowing through a cooling circuit for an engine, has an abnormality.

BACKGROUND ART

A coolant temperature sensor that detects the temperature of a coolant is arranged in a cooling circuit through which the coolant that cools an engine flows. Patent document 1 discloses an example of an abnormality determination device that determines whether or not such a coolant temperature sensor has an abnormality. The abnormality determination device of patent document 1 is configured to determine whether or not a coolant temperature sensor has an abnormality by, for example, comparing detection values of two coolant temperature sensors that are arranged in the cooling circuit.

PRIOR ART DOCUMENT

Patent Document

Patent Document 1: Japanese Laid-Open Patent Publication No. 2012-102687

SUMMARY OF THE INVENTION

Problems that are to be Solved by the Invention

In the abnormality determination device of patent document 1, for example, in a state in which the detected value of one of the coolant temperature sensors is fixed at an engine warming completion temperature, when the engine is restarted in an engine warming completion state, the discrepancy is small between the detection values of the two sensors. This results in a normality determination. Thus, it is desirable that the reliability of the determination result be increased in the abnormality determination device that uses the two coolant temperature sensors.

It is an object of the present invention to provide a coolant temperature sensor abnormality determination device that increases the reliability of a determination result of whether or not the coolant temperature sensor has an abnormality.

Means for Solving the Problem

A coolant temperature sensor abnormality determination device that solves the above problem includes an estimated temperature calculation unit configured to calculate an estimated temperature that is an estimated value of a temperature of a coolant that cools an engine and a determination unit configured to determine whether or not two coolant temperature sensors, which are configured to detect the temperature of the coolant, have an abnormality based on detection values of the two coolant temperature sensors and the estimated temperature. The determination unit has a determination permission condition under which a reference temperature is set to the estimated temperature of a present time point and the estimated temperature is then changed from the reference temperature by a determination temperature. The determination unit is configured to determine, when the determination permission condition is satisfied, that the two coolant temperature sensors are functioning normally if a discrepancy between the detection values of the two coolant temperature sensors is less than a normal temperature that is less than or equal to the determination temperature.

BRIEF DESCRIPTION OF THE DRAWINGS

FIG. 2 is a schematic diagram showing the circuit configuration of a cooling circuit for the engine system of FIG. 1, in which

EMBODIMENTS OF THE INVENTION

One embodiment of a coolant temperature sensor abnormality determination device will now be described with reference to FIGS. 1 to 6. First, the entire structure of an engine system including the coolant temperature sensor abnormality determination device will be described with reference to FIG. 1.

Overview of Engine System

Figure 1:
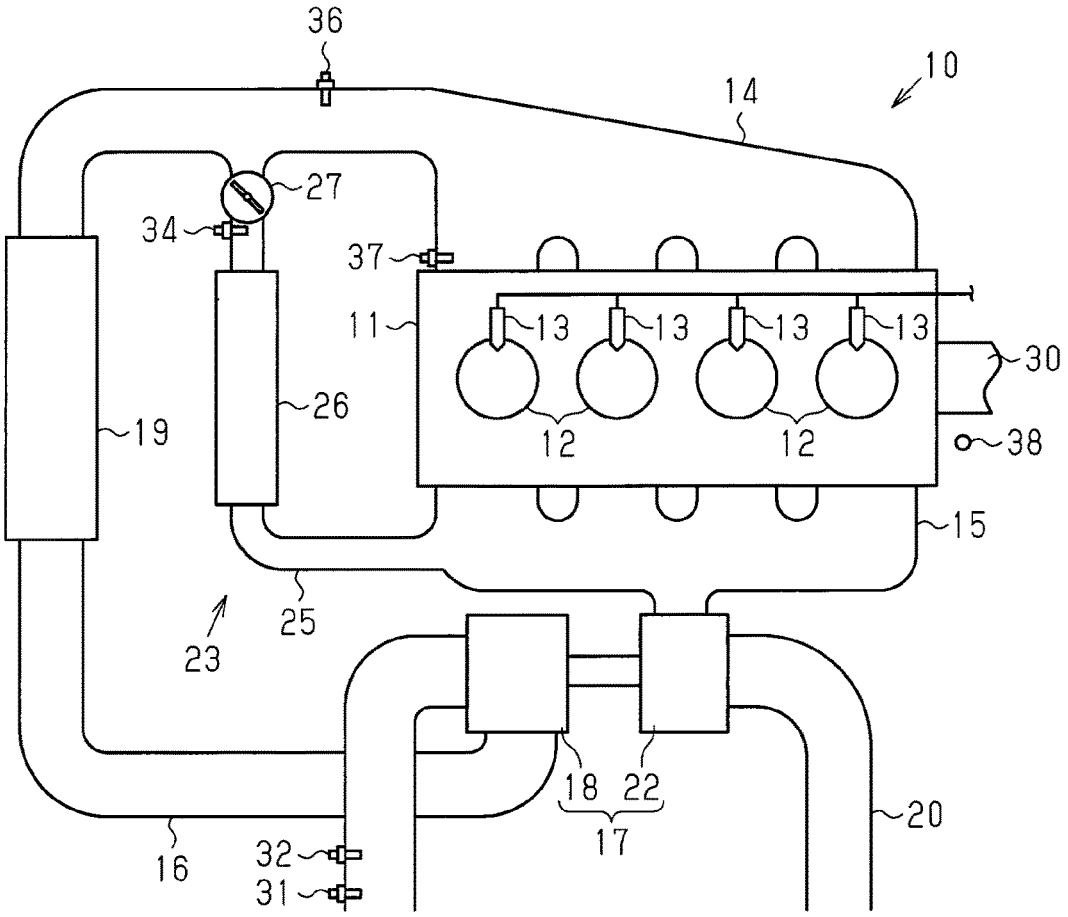
FIG. 1 is a schematic diagram showing the structure of an engine system including one embodiment of a coolant temperature sensor abnormality determination device.

As shown in FIG. 1, the engine system includes a water-cooled engine 10. A cylinder block 11 includes cylinders 12. An injector 13 injects fuel into each cylinder 12. An intake manifold 14 that supplies each cylinder 12 with intake air and an exhaust manifold 15 into which exhaust gas flows from each cylinder 12 are connected to the cylinder block 11. A member formed by the cylinder block 11 and a cylinder head (not shown) is referred to as the engine block.

An intake passage 16 connected to the intake manifold 14 includes, sequentially from an upstream side, an air cleaner (not shown), a compressor 18, which is an element forming a turbocharger 17, and an intercooler 19. An exhaust passage 20 connected to the exhaust manifold 15 includes a turbine 22, which is an element forming the turbocharger 17.

The engine system includes an EGR device 23. The EGR device 23 includes an EGR passage 25 that connects the exhaust manifold 15 and the intake passage 16. The EGR passage 25 includes a water-cooling EGR cooler 26 and an EGR valve 27, which is located closer to the intake passage 16 than the EGR cooler 26. When the EGR valve 27 is open, some of the exhaust gas is drawn into the intake passage 16 as EGR gas, and the cylinders 12 are supplied with working gas that is a mixture of exhaust gas and intake air.

The engine system includes various sensors. An intake air amount sensor 31 and an intake temperature sensor 32 are located at an upstream side of the compressor 18 in the intake passage 16. The intake air amount sensor 31 detects an intake air amount Ga, which is a mass flow rate of intake air that flows into the compressor 18. The intake temperature sensor 32 functions as an ambient temperature sensor and detects an intake temperature Ta, which is the temperature of the intake air, as an ambient temperature. An EGR temperature sensor 34 is located in the EGR passage 25 between the EGR cooler 26 and the EGR valve 27 to detect an EGR cooler outlet temperature $T_{egrc}$, which is the temperature of the EGR gas that flows into the EGR valve 27. A boost pressure sensor 36 is located between the intake manifold 14 and a portion of the EGR passage 25 connected to the intake passage 16 to detect a boost pressure Pb, which is a pressure of working gas. A working gas temperature sensor 37 is coupled to the intake manifold 14 to detect a working gas temperature Tim, which is the temperature of the working gas that flows into the cylinders 12. An engine speed sensor 38 detects an engine speed Ne, which is the speed of a crankshaft 30.

Cooling Circuit

The overview of a cooling circuit for the engine system will now be described with reference to FIG. 2.

Figure 2A:
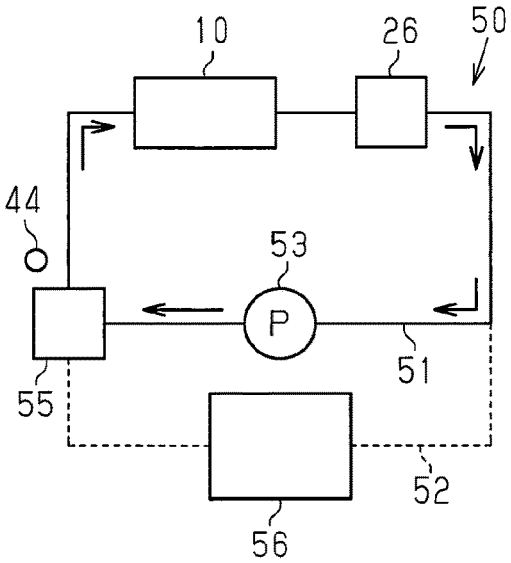
FIG. 2A is a diagram showing the flow of a coolant when a thermostat is closed.
Figure 2B:
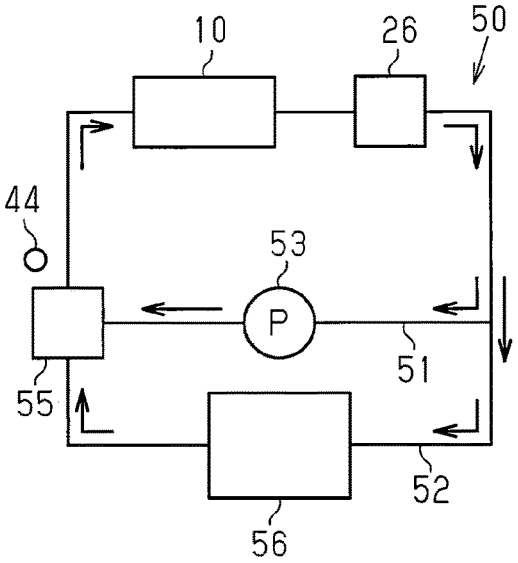
FIG. 2B is a diagram showing the flow of the coolant when the thermostat is open.

As shown in FIGS. 2A and 2B, a cooling circuit 50 includes a first cooling circuit 51 and a second cooling circuit 52. The first cooling circuit 51 includes a pump 53 that forcibly moves a coolant using the engine 10 as a power source. The second cooling circuit 52 is connected to an upstream side and a downstream side of the pump 53 of the first cooling circuit 51. The cooling circuit 50 includes a thermostat 55 located where the first cooling circuit 51 and the second cooling circuit 52 are connected.

The first cooling circuit 51 is a circuit including a coolant passage formed in the engine 10 and the EGR cooler 26. In the first cooling circuit 51, a coolant is circulated by the pump 53. The second cooling circuit 52 is a circuit including a radiator 56 that cools the coolant. The thermostat 55 opens and allows the coolant to flow to the radiator 56 when the temperature of the coolant is greater than or equal to an opening temperature. The opening temperature is a temperature that is greater than or equal to an engine warming completion temperature T1, at which the warming of the engine 10 is completed.

The thermostat 55 is activated so that the heat dissipation amount of the radiator 56 is in equilibrium with various heat absorption amounts. Thus, when the thermostat 55 is open, a coolant is controlled at an equilibrium temperature $T_{cthm}$. The equilibrium temperature $T_{cthm}$ is set based on the results of experiments that have been conducted in advance using an actual machine. Further, the cooling circuit 50 includes a coolant temperature detector 44 that detects the temperature of the coolant that passes through the thermostat 55. The coolant temperature detector 44 includes a first coolant temperature sensor 44*a* that detects a first coolant temperature Tw1, which is the temperature of the coolant, and a second coolant temperature sensor 44*b* that detects a second coolant temperature Tw2, which is also the temperature of the coolant (refer to FIG. 3). The coolant temperatures Tw1 and Tw2 are substantially equal when the coolant temperature sensors 44*a* and 44*b* are functioning normally.

Coolant Temperature Sensor Abnormality Determination Device

The coolant temperature sensor abnormality determination device (hereinafter referred to as the abnormality determination device) that determines whether or not the coolant temperature sensors have an abnormality will now be described with reference to FIGS. 3 to 6.

Figure 3:
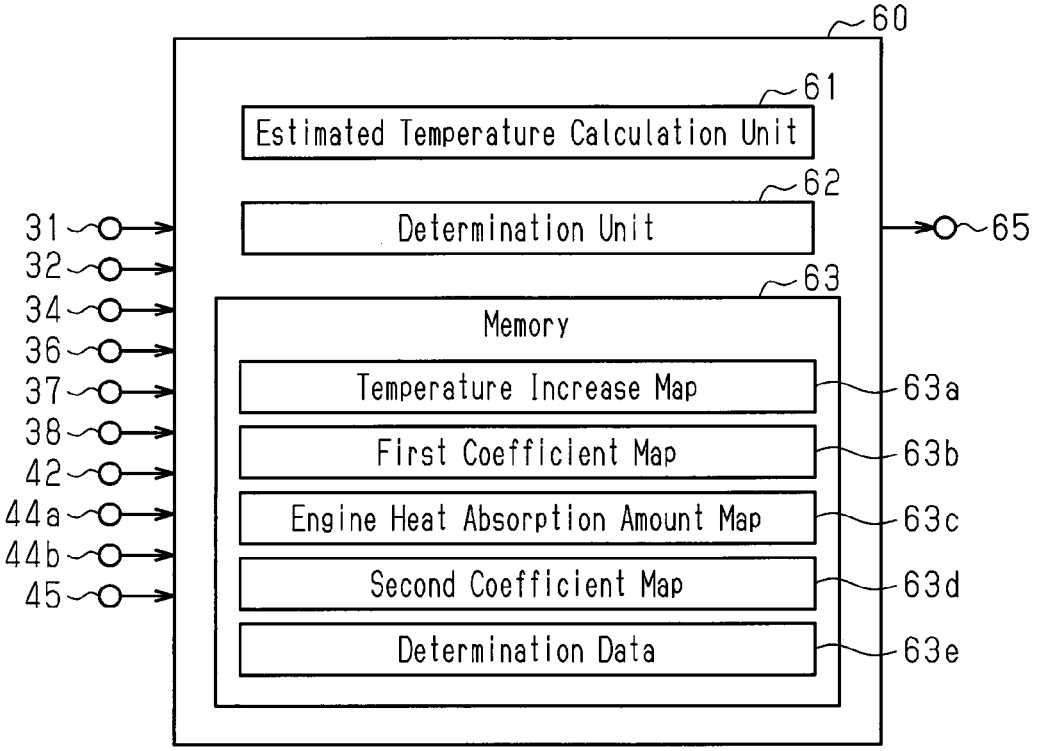
FIG. 3 is a functional block diagram showing the coolant temperature sensor abnormality determination device of the embodiment of FIG. 1.

As shown in FIG. 3, an abnormality determination device 60 is mainly configured by a microcomputer and can be achieved by, for example, circuitry, that is, one or more dedicated hardware circuits such as an ASIC, one or more processing circuits that operate in accordance with computer programs (software), or a combination thereof. The processing circuit includes a CPU and a memory 63 (for example, ROM and RAM) that stores a program or the like executed by the CPU. The memory 63, or computer readable medium, includes any usable medium that can be accessed by a versatile or dedicated computer. In addition to a signal from each sensor, the abnormality determination device 60 receives a signal indicating a fuel injection amount Gf, which is a mass flow rate of fuel, from the fuel injection controller 42, a signal indicating a vehicle speed v from a vehicle speed sensor 45, and the like. The abnormality determination device 60 determines whether or not the coolant temperature sensors 44*a* and 44*b* have an abnormality based on various programs stored in the memory 63 and various data such as an engine heat absorption amount map 63*c*. When a determination unit 62 determines that an abnormality has occurred in the coolant temperature sensors 44*a* and 44*b*, the abnormality determination device 60 turns on a malfunction indication lamp (MIL) 65 to notify a driver of the abnormality of the engine system.

The abnormality determination device 60 includes an estimated temperature calculation unit 61 (hereinafter referred to as the calculation unit 61) that calculates an estimated temperature Tc, which is the estimated value of each of the coolant temperatures Tw1 and Tw2, in predetermined control cycles (infinitesimal time dt). The abnormality determination device 60 also includes the determination unit 62 that determines whether or not the coolant temperature sensors 44*a* and 44*b* have an abnormality based on the estimated temperature Tc and the coolant temperatures Tw1 and Tw2.

Estimated Temperature Calculation Unit 61

The calculation unit 61 performs a calculation with the following equation (1) based on the signals from the various sensors to calculate the estimated temperature Tc using the coolant equilibrium temperature $T_{cthm}$ as an upper limit value. The calculation unit 61 sets the first coolant temperature Tw1 when the engine 10 is started to an initial value of the estimated temperature Tc. In equation (1), $T_{ci-1}$ is the previous value of the estimated temperature Tc, dq/dt is a calculation result of equation (2) and a heat balance q related to the coolant during the infinitesimal time dt, and C is an added value of a heat capacity of the coolant and a heat capacity of the engine block. In equation (2), a cylinder heat absorption amount $q_{cyl}$ is the amount of heat transferred from combustion gas to inner walls of the cylinders 12, and an EGR cooler heat absorption amount $q_{egr}$ is the heat absorption amount of the coolant in the EGR cooler 26. An engine heat absorption amount $q_{eng}$ is a heat absorption amount resulting from, for example, friction between the inner walls and pistons of the cylinders 12, adiabatic compression of working gas in the cylinders 12, and the like. A block heat dissipation amount $q_{blk}$ is the amount of heat dissipated from the engine block to the ambient air. Various calculations performed by the calculation unit 61 will now be described.

[Math. 1]

$$T_{Ci} = T_{ci-1} + \int \frac{dq}{dt}\frac{1}{C}\ T_{ci} \leq T_{cthm} \tag{1}$$

$$\frac{dq}{dt} = \frac{dq_{cyl}}{dt} + \frac{dq_{egr}}{dt} + \frac{dq_{eng}}{dt} - \frac{dq_{blk}}{dt} \tag{2}$$

Cylinder Heat Absorption Amount $q_{cyl}$ During Infinitesimal Time dt

When calculating the cylinder heat absorption amount $q_{cyl}$, the calculation unit 61 calculates a working gas amount Gwg, which is a mass flow rate of working gas supplied to the cylinders 12, and a working gas density ρim, which is the density of the working gas. The calculation unit 61 calculates the working gas amount Gwg and the working gas density ρim by performing a predetermined calculation based on an equation of state P×V=Gwg×R×T using the boost pressure Pb, the engine speed Ne, the displacement D of the engine 10, and the working gas temperature Tim.

Further, the calculation unit 61 calculates an exhaust temperature $T_{exh}$, which is the temperature of the exhaust gas in the exhaust manifold 15. As shown by equation (3), the calculation unit 61 calculates a temperature increase value when the mixture of the fuel injection amount Gf/working gas amount Gwg is burned at the engine speed Ne. Then, the calculation unit 61 calculates the exhaust temperature $T_{exh}$ by adding the working gas temperature Tim to the temperature increase value. The calculation unit 61 calculates a temperature increase value from a temperature increase map 63*a* stored in the memory 63. The temperature increase map 63*a* is a map that sets a temperature increase value for each engine speed Ne and fuel injection amount Gf/working gas amount Gwg based on the results of experiments and simulations that have been conducted in advance using an actual machine.

[Math. 2]

$$T_{exh} = f\left(N_e, \frac{G_f}{G_{wg}}\right) + T_{im} \tag{3}$$

In addition, as shown by equation (4), the calculation unit 61 calculates a first heat transfer coefficient $h_{cyl}$, which indicates how easy combustion gas heat is transferred to the inner walls of the cylinders 12 based on the engine speed Ne, the fuel injection amount Gf, and the working gas density ρim. The calculation unit 61 calculates the first heat transfer coefficient $h_{cyl}$ from a first coefficient map 63*b* stored in the memory 63. The first coefficient map 63*b* is a map that sets the first heat transfer coefficient $h_{cyl}$ for each engine speed Ne, the fuel injection amount Gf, and the working gas density ρim based on the results of experiments and simulations that have been conducted in advance using an actual machine. In equation (4), the engine speed Ne is a parameter of the average speed of each piston, the fuel injection amount Gf is a parameter of fuel injection pressure, and the working gas density ρim is a parameter of an exhaust speed of exhaust gas from the cylinders 12.

[Math. 3]

$$h_{cyl}=f(N_e, G_f, \rho_{im}) \tag{4}$$

As shown by equation (5), the calculation unit 61 calculates the cylinder heat absorption amount $q_{cyl}$ during the infinitesimal time dt by multiplying the first heat transfer coefficient $h_{cyl}$ and a surface area $A_{cyl}$ of each cylinder 12 by the temperature difference between the exhaust temperature $T_{exh}$ and the previous value $T_{ci-1}$ of the estimated temperature. The cylinder heat absorption amount $q_{cyl}$ is the amount of heat exchange between the combustion gas and the inner walls of the cylinders 12. The surface area of each cylinder 12 is the surface area of a cylinder in which the bore diameter of each cylinder 12 is a diameter and the stroke amount of each piston is a height.

[Math. 4]

$$\frac{dq_{cyl}}{dt} = A_{cyl} \cdot h_{cyl} \cdot (T_{exh} - T_{ci-1}) \tag{5}$$

EGR Cooler Heat Absorption Amount $q_{egr}$ During Infinitesimal Time dt

When calculating the EGR cooler heat absorption amount $q_{egr}$, the calculation unit 61 calculates a value obtained by subtracting the intake air amount Ga from the working gas amount Gwg as an EGR amount $G_{egr}$. As shown by equation (6), the calculation unit 61 calculates the EGR cooler heat absorption amount $q_{egr}$ during the infinitesimal time dt by multiplying the temperature difference between the exhaust temperature $T_{exh}$ and the EGR cooler outlet temperature $T_{egrc}$ by the EGR amount $G_{egr}$ and a constant-volume specific heat Cv of exhaust gas.

[Math. 5]

$$\frac{dq_{egr}}{dt} = G_{egr} \cdot C_v \cdot (T_{exh} - T_{egrc}) \tag{6}$$

Engine Heat Absorption Amount $q_{eng}$ During Infinitesimal Time dt

As shown by equation (7), the calculation unit 61 calculates the engine heat absorption amount $q_{eng}$ that uses the engine speed Ne as a parameter. The calculation unit 61 calculates the engine heat absorption amount $q_{eng}$ during the infinitesimal time dt from the engine heat absorption amount map 63*c* stored in the memory 63. The engine heat absorption amount map 63*c* is a map that sets the engine heat absorption amount $q_{eng}$ during the infinitesimal time dt for each engine speed Ne based on the results of experiments and simulations that have been conducted in advance using an actual machine.

[Math. 6]

$$\frac{dq_{eng}}{dt} = f(N_e) \tag{7}$$

Block Heat Dissipation Amount $q_{blk}$ During Infinitesimal Time dt

When calculating the block heat dissipation amount $q_{blk}$, as shown by equation (8), the calculation unit 61 calculates a second heat transfer coefficient $h_{blk}$, which indicates how easy heat is transferred between the engine block and the ambient air based on the vehicle speed v. The calculation unit 61 calculates the second heat transfer coefficient $h_{blk}$ from a second coefficient map 63*d* stored in the memory 63. The second coefficient map 63*d* is a map that sets the second heat transfer coefficient $h_{blk}$ for each vehicle speed v based on the results of experiments and simulations that have been conducted in advance using an actual machine. As shown by equation (9), the calculation unit 61 calculates the block heat dissipation amount $q_{blk}$ during the infinitesimal time dt by multiplying a surface area $A_{blk}$ of the engine block and the second heat transfer coefficient $h_{blk}$ by the temperature difference between the previous value $T_{ci-1}$ of the estimated temperature Tc and the intake temperature Ta. The surface area $A_{blk}$ of the engine block is the area of a portion of the entire surface of the engine block excluding the portion located at the rear side with respect to the travelling direction. That is, the surface area $A_{blk}$ is the total area of a front surface portion where the current of air directly strikes and side surface portions along which the current of air flows in a direction opposite to the travelling direction.

[Math. 7]

$$h_{blk} = f(v) \tag{8}$$

$$\frac{dq_{blk}}{dt} = A_{blk} \cdot h_{blk} \cdot (T_{ci-1} - T_a) \tag{9}$$

The calculation unit 61 that has calculated the various heat amounts described above calculates the estimated temperature Tc by adding a value obtained by dividing the heat balance q by a heat capacity C to the previous value $T_{ci-1}$ as a temperature change amount in accordance with the above (1). As shown by equation (1), the calculation unit 61 calculates the estimated temperature Tc using the coolant equilibrium temperature $T_{cthm}$ as an upper limit value. Thus, for example, when the previous value $T_{ci-1}$ is the equilibrium temperature $T_{cthm}$, the estimated temperature Tc is maintained at the equilibrium temperature $T_{cthm}$ when the heat balance q is a positive value, and the estimated temperature Tc is lower than the equilibrium temperature $T_{cthm}$ when the heat balance q is a negative value. The heat balance q is a positive value when the engine 10 is in a normal drive state. The heat balance q is a negative value, for example, when the engine 10 is idling at a cold location or the engine 10 is in a low-load, low-speed state on a downhill. The state in which the heat balance q is a negative value is hereinafter referred to as the heat dissipation state.

Determination Unit 62

The determination unit 62 determines whether or not the coolant temperature sensors 44*a* and 44*b* have an abnormality based on the estimated temperature Tc, which is a calculation result of the calculation unit 61, the coolant temperatures Tw1 and Tw2, and determination data 63*e* stored in the memory 63. The determination unit 62 performs an abnormality determination process of determining that an abnormality has occurred in the coolant temperature sensors 44*a* and 44*b* in parallel with a normality determination process of determining that the coolant temperature sensors 44*a* and 44*b* are functioning normally.

Abnormality Determination Process

Figure 4:
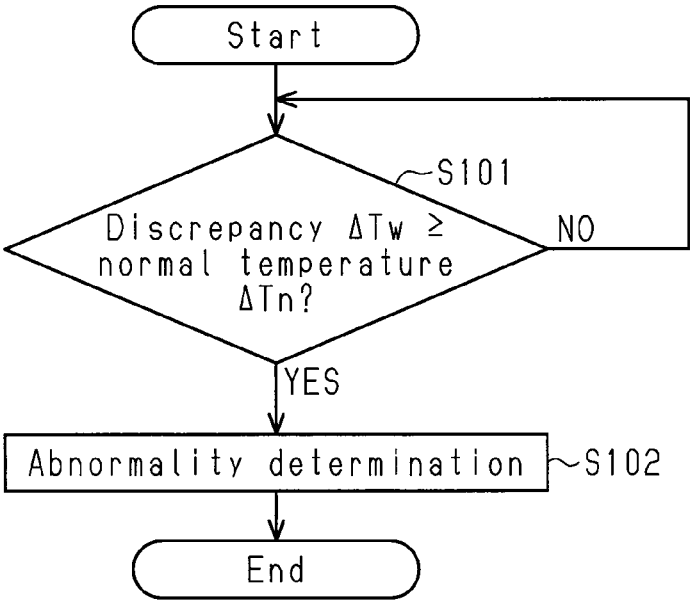
FIG. 4 is a flowchart showing an example of procedures executed in an abnormality determination process performed by the abnormality determination device of FIG. 3.

As shown in FIG. 4, in the abnormality determination process, the determination unit 62 obtains the coolant temperatures Tw1 and Tw2 and determines whether or not a discrepancy ΔTw (=|Tw1−Tw2|) is greater than or equal to a normal temperature ΔTn (step S101). The normal temperature ΔTn is a value set in the determination data 63*e* and is, for example, "15° C.," which is less than or equal to a determination temperature ΔTj (described below). That is, the value (temperature width) serving as the normal temperature ΔTn is set to a value that is less than or equal to the value (change amount) set as the determination temperature ΔTj. When the discrepancy ΔTw is greater than or equal to the normal temperature ΔTn (step S101: YES), the determination unit 62 determines that an abnormality has occurred in the coolant temperature sensors 44*a* and 44*b* (step S102) and ends the abnormality determination process. When the discrepancy ΔTw is less than the normal temperature ΔTn (step S101: NO), the determination unit 62 obtains the coolant temperature temperatures Tw1 and Tw2 again and determines whether or not the discrepancy ΔTw is greater than or equal to the normal temperature ΔTn.

Normality Determination Process

The normality determination process performed by the determination unit 62 will now be described with reference to FIG. 5. The normality determination process is repeatedly performed until the abnormality is determined in the abnormality determination process. Further, the calculation unit 61 calculates the estimated temperature Tc in parallel with the normality determination process.

Figure 5:
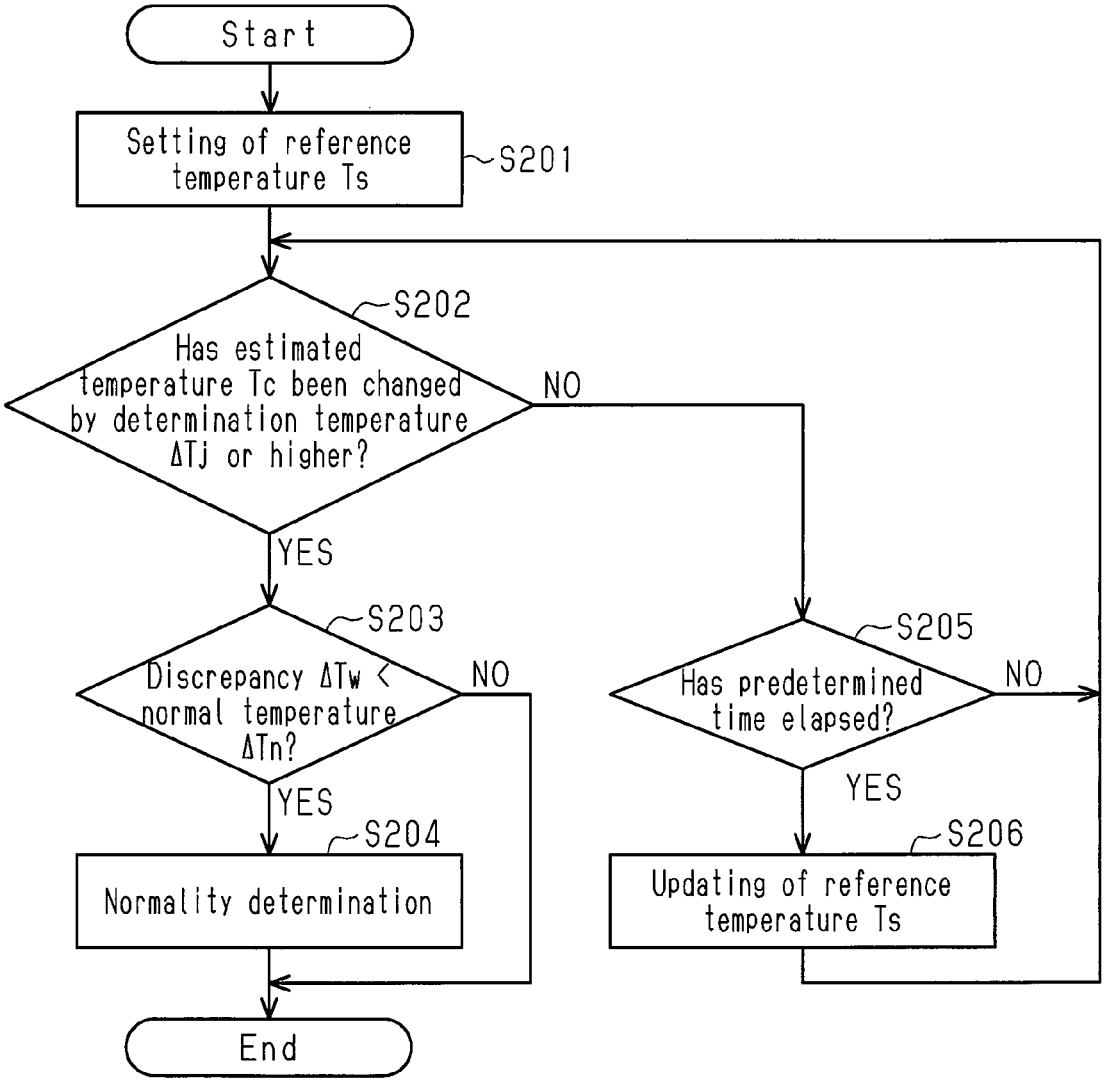
FIG. 5 is a flowchart showing an example of the procedures executed in a normality determination process performed by the abnormality determination device of FIG. 3.

As shown in FIG. 5, in step S201, the determination unit 62 sets a reference temperature Ts to the estimated temperature Tc of the present time point. When the engine 10 starts, the reference temperature Ts is set to the first coolant temperature Tw1, which is the detection value of the first coolant temperature sensor 44*a*. Subsequently, the determination unit 62 determines whether or not the estimated temperature Tc has been changed by the determination temperature ΔTj or higher based on the difference between the estimated temperature Tc and the reference temperature Ts (step S202). The determination temperature ΔTj is a value set in the determination data 63*e* and is, for example, "20° C.," which is higher than the normal temperature ΔTn.

When the change amount of the estimated temperature Tc is greater than or equal to the determination temperature ΔTj (step S202: YES), the determination unit 62 determines that the determination permission condition has been satisfied and obtains the coolant temperatures Tw1 and Tw2 to determine whether or not the discrepancy ΔTw is less than the normal temperature ΔTn (step S203).

When the discrepancy ΔTw is less than the normal temperature ΔTn (step S203: YES), the determination unit 62 determines that the coolant temperature sensors 44*a* and 44*b* are functioning normally (step S204) and temporarily ends the normality determination process. When the discrepancy ΔTw is greater than or equal to the normal temperature ΔTn (step S203: NO), the determination unit 62 ends the normality determination process. Here, the determination unit 62 determines that an abnormality has occurred in the coolant temperature sensors 44*a* and 44*b* in the abnormality determination process performed in parallel with the normality determination process.

When the change amount of the estimated temperature Tc is lower than the determination temperature ΔTj (step S202: NO), the determination unit 62 determines whether or not a predetermined time has elapsed from when the reference temperature Ts was set (step S205). When the predetermined time has not elapsed (step S205: NO), the determination unit 62 determines again in step S202 whether or not the change amount of the estimated temperature Tc is greater than or equal to the determination temperature ΔTj. When the predetermined time has elapsed (step S205: YES), the determination unit 62 updates the reference temperature Ts by resetting the reference temperature Ts to the estimated temperature Tc (step S206) and then determines again in step S202 whether or not the change amount of the estimated temperature Tc is greater than or equal to the determination temperature ΔTj.

Operation

Figure 6:
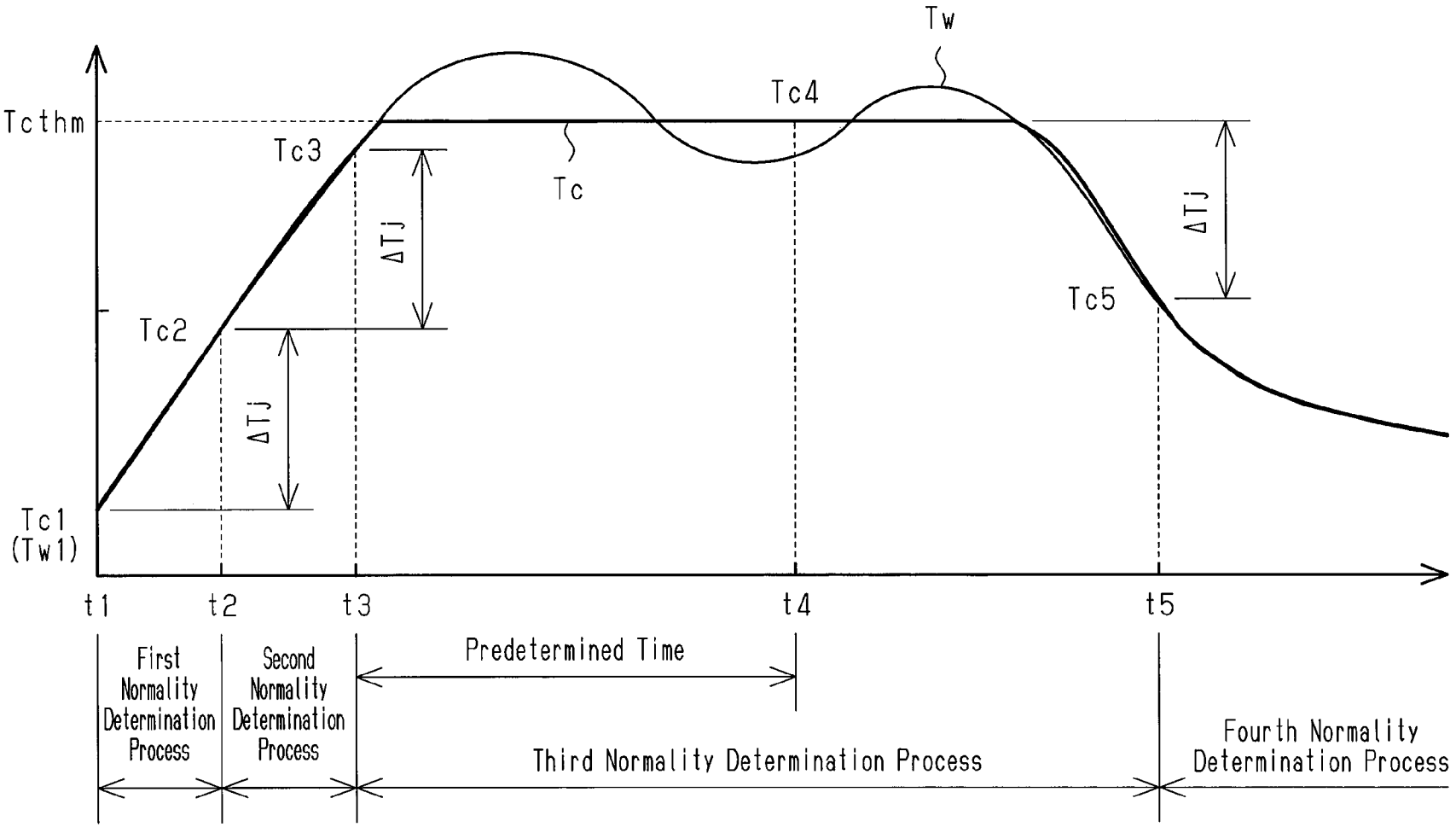
FIG. 6 is a timing chart showing the relationship of changes in an estimated temperature estimated by the abnormality determination device of FIG. 3 and the normality determination process of FIG. 5.

The operation of the abnormality determination device 60 when the coolant temperature sensors remain functioning normally from a cold start of the engine 10 will now be described with reference to FIG. 6. In FIG. 6, "Tw" represents the actual temperature of a coolant.

Referring to FIG. 6, when the engine 10 starts at time t1, a first normality determination process starts. In the first normality determination process, the first coolant temperature Tw1, which is the detection value of the first coolant temperature sensor 44*a*, is set to an initial value Tc1 of the estimated temperature Tc and the reference temperature Ts. At time t2 in which the estimated temperature Tc has been changed from the reference temperature Ts by the determination temperature ΔTj, after the determination permission condition is satisfied, the discrepancy ΔTw between the coolant temperatures Tw1 and Tw2 is less than the normal temperature ΔTn. Thus, the normality is determined and the first normality determination process ends.

At time t2, a second normality determination process starts. In the second normality determination process, the reference temperature Ts is set to the estimated temperature Tc2 at time T2. At time t3 in which the estimated temperature Tc has been changed by the determination temperature ΔTj, after the determination permission condition is satisfied, the normality is determined and the second normality determination process ends.

At time t3, a third normality determination process starts. In the third normality determination process, the reference temperature Ts is set to the estimated temperature Tc3 at time t3. However, the estimated temperature Tc is maintained at the coolant equilibrium temperature $T_{cthm}$, and the estimated temperature Tc has not been changed by the determination temperature ΔTj at time t4, which is when a predetermined time has elapsed from time t3. Thus, at time t4, the reference temperature Ts is updated to an estimated temperature Tc4 at time t4. At time t5 in which the estimated temperature Tc has been changed from the updated reference temperature Ts by the determination temperature ΔTj, after the determination permission condition is satisfied, the normality is determined and the third normality determination process ends. At time t5, an estimated temperature Tc5 at time t5 is set to the reference temperature Ts to start a fourth normality determination process. In this manner, the abnormality determination device 60 repeatedly performs the normality determination on the coolant temperature sensors 44*a* and 44*b*.

The coolant temperature sensor abnormality determination devices of the above embodiment have the advantages described below.

(1) The estimated temperature Tc has to be changed by the determination temperature ΔTj for the normality determination to be performed on the coolant temperature sensors 44*a* and 44*b*. In other words, when the estimated temperature Tc is changed by the determination temperature ΔTj, the normality is determined on the coolant temperature sensors 44*a* and 44*b*. This increases the reliability of the normality determination. As a result, the reliability of the determination result increases.

(2) Regardless of whether or not the determination permission condition has been satisfied, when the discrepancy ΔTw between the detection values of the coolant temperature sensors 44*a* and 44*b* is greater than or equal to the normal temperature ΔTn, the abnormality determination device 60 determines that an abnormality has occurred in the coolant temperature sensors 44*a* and 44*b*. This allows for quick detection of the occurrence of an abnormality in the coolant temperature sensors 44*a* and 44*b*.

(3) The abnormality determination device 60 resets the reference temperature Ts when the determination permission condition is not satisfied for the predetermined time. This avoids situations in which the determination that the coolant temperature sensors 44*a* and 44*b* are functioning normally is not performed over a long time.

(4) The estimated temperature Tc is calculated based on the heat balance q of the cylinder heat absorption amount $q_{cyl}$, the EGR cooler heat absorption amount $q_{egr}$, the engine heat absorption amount $q_{eng}$, and the block heat dissipation amount $q_{blk}$. This increases the accuracy of the estimated temperature Tc.

(5) The calculation unit 61 calculates the estimated temperature Tc using the equilibrium temperature $T_{cthm}$ as an upper limit value. In this configuration, there is no need to take into account the amount of heat dissipated from the radiator 56 when the thermostat 55 is open. This decreases the load on the calculation unit 61 for calculating the estimated temperature Tc and eliminates the need for, for example, a configuration that calculates the amount of heat dissipated from the radiator 56. Thus, the abnormality determination device 60 can be formed by fewer elements.

(6) In the above embodiment, the working gas density ρim is used as a parameter of the exhaust speed of exhaust gas from the cylinders 12. The density of the exhaust gas in the exhaust manifold 15 through which the exhaust gas flows, rather than the working gas density ρim, may be considered as the preferred parameter of the exhaust speed of exhaust gas from the cylinders 12. However, when the density of exhaust gas in the exhaust manifold 15 is used, an additional sensor having superior durability with respect to the temperature and elements of exhaust gas will be necessary. In this regard, in the above embodiment, the working gas density ρim is used as a parameter of the exhaust speed of exhaust gas from the cylinders 12. Thus, conventional sensors of the engine system can be used. This allows for the reduction of the components and costs of the abnormality determination device 60.

The above embodiment may be modified as follows.

Under the condition in which the coolant temperature Tw is greater than or equal to the opening temperature of the thermostat 55, the calculation unit 61 may calculate the estimated temperature Tc by calculating the heat dissipation amount in the radiator 56 and taking the calculated value into account. The heat dissipation amount in the radiator 56 can be calculated based on, for example, the change amount of the first coolant temperature Tw1, the amount of a coolant, and the heat capacity of the coolant.

The calculation unit 61 may calculate the first heat transfer coefficient $h_{cyl}$ using the density of exhaust gas in the exhaust manifold 15 instead of the working gas density ρim. This configuration increases the accuracy of the first heat transfer coefficient $h_{cyl}$. As a result, the accuracy of the estimated temperature Tc increases. The density of the exhaust gas can be calculated from, for example, the pressure and temperature of the exhaust manifold 15.

The calculation unit 61 may calculate the EGR cooler heat absorption amount $q_{egr}$ based on the difference between the EGR cooler outlet temperature $T_{egrc}$ and the detection value of the temperature sensor that detects the temperature of EGR gas flowing into the EGR cooler 26.

When the EGR cooler 26 is of an air-cooled type, the calculation unit 61 may calculate an added value of the cylinder heat absorption amount $q_{cyl}$ and the engine heat absorption amount $q_{eng}$ as a heat absorption amount of a coolant.

When the estimated temperature Tc reaches the equilibrium temperature $T_{cthm}$, the determination unit 62 may set the reference temperature Ts to the equilibrium temperature $T_{cthm}$. Such a configuration decreases the temperature change amount that is needed when the estimated temperature Tc is changed by the determination temperature ΔTj after reaching the equilibrium temperature $T_{cthm}$ as compared to a configuration in which the reference temperature Ts is set to the estimated temperature Tc obtained slightly before reaching the equilibrium temperature $T_{cthm}$. This increases the frequency in which normality determinations are performed on the coolant temperature sensors 44*a* and 44*b*.

The determination unit 62 may perform normality determination processes in parallel that set the reference temperature Ts to the estimated temperatures Tc at different times. This increases the frequency in which normality determinations are performed on the coolant temperature sensors 44*a* and 44*b*.

The determination unit 62 may continue the normality determination process after the engine 10 stops. That is, in a process in which the coolant temperature Tw decreases, the determination unit 62 may determine whether or not there is an abnormality based on the discrepancy ΔTw between the coolant temperatures Tw1 and Tw2 when the estimated temperature Tc after the engine 10 stops is changed by the determination temperature ΔTj from the reference temperature Ts that is set during the driving of the engine 10.

When detecting an abnormality, the determination unit 62 may detect, as a sensor in which an abnormality has occurred, a sensor detecting a detection value that is further deviated from the estimated temperature Tc of the first and second coolant temperature sensors 44*a* and 44*b*.

The engine 10 may be a diesel engine, a gasoline engine, or a natural gas engine. Further, the MIL 65 may be, for example, a warning sound generator that generates a warning sound.

What is claimed is:

1. A coolant temperature sensor abnormality determination device comprising:

an estimated temperature calculation unit configured to calculate an estimated temperature that is an estimated value of a temperature of a coolant that cools an engine; and a determination unit configured to determine whether or not two coolant temperature sensors, which are configured to detect the temperature of the coolant, have an abnormality based on detection values of the two coolant temperature sensors and the estimated temperature, wherein the determination unit has a determination permission condition under which a reference temperature is set to the estimated temperature of a present time point and the estimated temperature is then changed from the reference temperature by a determination temperature, and the determination unit is configured to determine, when the determination permission condition is satisfied, that the two coolant temperature sensors are functioning normally if a discrepancy between the detection values of the two coolant temperature sensors is less than a normal temperature that is less than or equal to the determination temperature.

2. The coolant temperature sensor abnormality determination device according to claim 1, wherein the determination unit is configured to determine that an abnormality has occurred in the two coolant temperature sensors when the discrepancy between the detection values of the two coolant temperature sensors is greater than or equal to the normal temperature regardless of whether or not the determination permission condition has been satisfied.

3. The coolant temperature sensor abnormality determination device according to claim 1, wherein the determination unit is configured to update the reference temperature to the estimated temperature of the present time point if a predetermined time has elapsed from when the reference temperature was set without the determination permission condition being satisfied.

4. The coolant temperature sensor abnormality determination device according to claim 1, wherein the engine includes an EGR device that recirculates some exhaust gas into an intake passage as EGR gas, the EGR device includes an EGR cooler that cools the EGR gas with the coolant, the estimated temperature calculation unit is configured to calculate:

a cylinder heat absorption amount that is a heat absorption amount based on an engine speed, a fuel injection amount, an amount of working gas drawn into a cylinder, a temperature of the working gas, the estimated temperature of a previous time, and a density of the working gas or a density of the exhaust gas in an exhaust manifold;

an EGR cooler heat absorption amount that is a heat absorption amount based on a mass flow rate of the EGR gas and a temperature change in the EGR gas of the EGR cooler;

an engine heat absorption amount that is a heat absorption amount based on the engine speed; and a block heat dissipation amount that is an amount of heat dissipated from an engine block based on a vehicle speed, an ambient temperature, the estimated temperature of the previous time, and a surface area of the engine block, and the estimated temperature calculation unit is configured to add a value obtained by dividing a heat balance based on the cylinder heat absorption amount, the EGR cooler heat absorption amount, the engine heat absorption amount, and the block heat dissipation amount by an added value of a heat capacity of the engine block and a heat capacity of the coolant to the estimated temperature of the previous time in order to calculate the estimated temperature.

5. The coolant temperature sensor abnormality determination device according to claim 1, wherein a cooling circuit through which the coolant flows includes a thermostat configured to open and allow the coolant to flow to a radiator when the temperature of the coolant is greater than or equal to an opening temperature, and the estimated temperature calculation unit is configured to calculate the estimated temperature using an equilibrium temperature of the coolant as an upper limit value when the thermostat is open.

* * * * *